US006869679B1

(12) United States Patent
Negola

(10) Patent No.: US 6,869,679 B1
(45) Date of Patent: Mar. 22, 2005

(54) DYED OLEFIN YARN AND TEXTILE FABRICS USING SUCH YARNS

(76) Inventor: Edward J. Negola, 1247 Carlene Ave., Fort Myers, FL (US) 33901

( * ) Notice: Subject to any disclaimer, the term of this patent is extended or adjusted under 35 U.S.C. 154(b) by 0 days.

(21) Appl. No.: 10/669,200

(22) Filed: Sep. 24, 2003

Related U.S. Application Data

(60) Provisional application No. 60/417,053, filed on Oct. 8, 2002.

(51) Int. Cl.[7] ..... D01F 6/00; D06M 11/00

(52) U.S. Cl. ..... 428/364; 428/394; 428/373; 8/130.1

(58) Field of Search ..... 8/130.1; 428/364, 428/373, 394; 524/140

(56) References Cited

U.S. PATENT DOCUMENTS 5,576,366 A * 11/1996 Sheth ..... 524/140

2003/0211347 A1 * 11/2003 Rabinovitch et al. ..... 428/483

* cited by examiner

*Primary Examiner*—N. Edwards

(74) *Attorney, Agent, or Firm*—Schweitzer Cornman Gross & Bondell LLP

(57) ABSTRACT

A novel olefin textile fabric knitted woven and non-woven that in one aspect of the invention is disperse dyed to a light, medium or deep solid shade. In another aspect, the textile fabrics of the present invention are manufactured using olefin yarns that contain variable amounts of dye acceptor additives. A fabric with more than one tone of a color is dyed in a single dye bath. The fabrics and yarn using this invention can be processed using conventional spinning, weaving, knitting, web forming machines and will dye using existing dyeing and finishing systems. This invention is of particular value in the apparel and home furnishings industry.

4 Claims, No Drawings

DYED OLEFIN YARN AND TEXTILE FABRICS USING SUCH YARNS

RELATED APPLICATIONS

This application claims the priority of applicant's provisional application Ser. No. 60/417,053, filed Oct. 8, 2002.

BACKGROUND OF THE INVENTION

The present invention relates to textile fabrics manufactured using olefin fibers or yarns modified to dye using disperse dyes. These fabrics are conventionally colored using existing disperse dye or printing systems. Either solid shades or multiple tones of a shade are achieved in a single dye bath or print application. The fabrics in this invention are manufactured into greige goods produced by the knitting, weaving or non-woven process. Solid shades are achieved by grafting into the olefin yarn or fiber with one level of dye additive and subjecting the fabric to a disperse dye bath. Multiple ends of yarn each containing, differing percentages of dye additives are manufactured into fabrics. The fabric will dye to multiple tones in a single dye bath. By increasing the amount of disperse dyeable additive in the olefin yarn or fiber, the affinity for disperse dye increases accordingly. The fabrics manufactured according to this invention are stored at the dye house undyed. Color is then added using conventional disperse dye machines or print dye methods. Surprising and novel effects are achieved using economical conventional disperse dye systems known to those skilled in the art. This invention is of particular usefulness in the apparel and home furnishings industry. The fabrics produced feel and, appear as conventional fabrics but are approximately 30–38% lighter in weight. This is due to the fact that the specific gravity of olefin is 0.91 while the specific gravity of cotton or polyester is 1.38. In addition, the light fastness and wash fastness properties are similar to those of polyester.

BRIEF DESCRIPTION OF THE RELATED ART

Knitted and woven fabrics and textile articles are an enormous worldwide enterprise. Cotton is the predominant choice of fiber used to make woven or knitted textile fabrics. Cotton has been used through the ages to make yarn and textile articles. Cotton is a natural fiber and is grown in many parts of the world. Many cotton-spinning systems exist worldwide. Cotton yarns are easily produced for both apparel and home furnishings using the cotton spinning system. Egyptian and United States cotton staple is the most widely used cotton to produce yarn and fabrics.

The cotton spinning system starts with bales of cotton picked from the fields. The fiber is called "staple" and is usually ¾" to 1.5" in length. The longer length cotton is more expensive than the shorter length staple. Longer length staple will result in a superior spun yarn. Machines clean, card, and make roving to various sizes. Cotton is made into yarn of various sizes by twisting or "spinning" the roving on machines well known in this art. A yarn is produced to be either knitted or woven to create fabric for apparel or home furnishings. By using varying sizes of large or small yarns the knitting or weaving manufacturer can make various types of garments or furnishings. If the cotton fabric is manufactured and kept in the undyed state the fabric is called a greige fabric. This is the most common and economical method of manufacturing the most widely used cotton fabrics. Normally the dying or printing of the fabric is done after orders are received from the end user of the fabric. The dyed cotton fabric is then cut into the proper shapes and all sorts of apparel garments are sewn together from these parts. Cotton is used to make underwear, socks, sweaters, shirts, slacks, casual sports wear and dresses. Cotton is not usually used to make sports jackets, men's or ladies suits or outerwear The most common system of putting color on cotton apparel fabric is to dye: the woven, knitted or non-woven fabric. The fabric is placed in a machine containing water, vat or direct dyes and chemicals. The temperature of the liquor or dye bath is adjusted to the desired degree. The skilled operator will use this, process to produce the desired shade on the cotton fabric. The fabric is dried, and finished according to the customer's specifications. The dye house is a capital-intensive operation that contains expensive dye and finishing equipment. A dye house in addition to dyeing will have drying and finishing equipment such as compactors, chemical applicators and rolling or folding equipment. A good substitute for cotton would ideally be able to be processed using present cotton spinning, dyeing and finishing equipment systems to dye and finish cotton are in place worldwide.

Cotton has been the choice in fabrics for the following reasons:

1. Cotton is easily grown in many-parts of the world.
2. Cotton is easily converted into yarn because it grows to standard staple lengths.
3. Cotton yarns process well on most knitting and weaving machines.
4. Cotton fabrics are soft to the touch and feel comfortable to the users body.
5. Cotton wicks and absorbs moisture.
6. Cotton dyes very easily.
7. Cotton blends well with other synthetic fibers.

Cloth knitted or woven of cotton has standard nomenclature and is purchased as a commodity from most parts of the world. A manufacturer can buy a standard cotton fabric from anywhere in the world. Then the manufacturer sends the cloth to a dye house to be stored as uncolored greige cloth awaiting orders for colored cloth. The dyed cloth is cut and sewn into apparel garments or home furnishing items such as draperies, bedspreads, or upholstery.

Synthetics:

Many attempts have been tried to create an acceptable synthetic fiber or yarn that is a good substitute for cotton and will process on conventional spinning equipment.

The worldwide demand for cotton is such that synthetic substitutes had to be introduced since there would not be enough acreage available to produce enough cotton world wide to meet the demand for affordable fabrics and garments for the growing multitude of human population. It is very desirable to produce synthetic substitutes for cotton.

Many attempts have been made to produce a synthetic substitute for cotton. Rayon and rayon acetate were the first successful attempts to produce a substitute for cotton. Cellulose from wood is used in the Rayon process. Rayon and rayon acetate is widely used in the apparel and home furnishings industry. However producing these yarns and fibers causes a great deal of pollution and they are not produced in the United States of America. The rayon process uses caustic and anhydride in great quantities. Rayon has very desirable qualities. It is easy to dye, and the garments produced are bright and soft and are a good, substitute for cotton. Since most rayon has to be imported and manufactured by specialty manufactures it is expensive and not used as a choice except for expensive high fashion garments. Rayon is also blended with cotton or other synthetics to make fabrics having desirable characteristics such as feel or drape. Rayon or acetate has the same specific gravity as cotton. These fibers do not provide a weight advantage when it is substituted for cotton. Their specific gravity is the same as the specific gravity of cotton.

Acrylics:

Synthetic fiber made using the acrylonitrile process is also used to make a soft fiber. Brands such as Acrilan from the Solutia Co., Creslan from American Cyanamid and Mannacryl from Mann Industries are examples. This fiber is not easily dyed and is mostly produced in large pigment dyed lots. Additionally acrylic is more expensive than cotton. It has a specific gravity of 1.17, which makes it ideal for a blend with wool for sweaters and for use in hosiery. Because it is solution dyed the yarn made from acrylic fibers is suited ideally for outdoor use in awnings, lawn and garden upholstery. Acrylic fiber is not a good substitute for cotton.

Polyester:

Synthetics, the majority being polyester, account for almost one half of all fibers used to produce textile fabrics.

Almost 60 years ago, polyester staple was introduced by the Dupont Company to be a replacement for cotton. It did not replace cotton but it is commonly used to mix or blend with cotton. Initially polyester was harsh and coarse. It did not absorb moisture well and is very difficult to dye. Over a long period of years polyester fibers were engineered to feel soft, and to blend with cotton so that a yarn could be made using the cotton spinning system. The most popular polyester is called "micro denier". Micro denier is extruded through spinneret holes that make a size of fiber that is smaller than cotton. It is very common to find blends of 60% cotton with 40% polyester. There are many blends of cotton/polyester. These blends are found in knitted and woven textile fabrics. Many expensive modifications were made to be able to spin and then dye fabrics made from blends of polyester and cotton. In today's modern dye and finishing facilities undyed fabrics made from yarns that are blends of cotton and polyester are dyed finished and shipped to the end user in solid colors. It takes great skill to match the cotton shade which is dyed with one type of dye, to the polyester shade which is dyed using disperse dye. When dyeing blends of this nature, a two-step process is used and it is more expensive than using a one step process.

Polyester has many drawbacks. It is difficult to dye and great skill is needed to dye a uniform shade of polyester and cotton. The polyester fibers require high temperatures under pressure to absorb high energy disperse dyes. Cotton dyes with direct or vat dyes that do not require pressure or high temperatures. The dye houses that dye a cotton/polyester blend are highly skilled: Fabrics made with blends of cotton and polyester must be dyed using the two-step, process. First one then the other is dyed. Most skilled dye houses keep large quantities of disperse shades for the purpose of dyeing polyester and blends of polyester and cotton.

Manufacturing polyester is a very large enterprise. Approximately 33 billion pounds of polyester are produced world wide for application in apparel and home furnishings. While polyester is widely used world wide, it has many disadvantages.

Polyester has the following disadvantages:

1. It requires great skill to blend polyester with cotton
2. Polyester is difficult to dye
3. Polyester is warm to the body
4. Textile fabrics made using 100% Polyester feel heavy.
5. High temperatures and pressure are required to dye or print polyester.
6. Polyester will not wick moisture.

It is very desirable in the apparel and home furnishings industry to have available a synthetic yarn or fabric that has novel characteristics. Ideally the synthetic fiber could be used to make a yarn for a fabric that would be similar to a fabric made from 100% cotton. Polyester does not meet these standards.

Olefin:

Olefin (polypropylene, polyethylene) is a manufactured fiber, which is composed of at least 85% ethylene, propylene or other olefin units. Olefin is an ideal substitute for cotton except for the fact that is not easily dyed on conventional dyeing or printing systems. Olefin is easy and economical to produce into fiber that feels just like cotton. I have found that an olefin of 1.8 denier per filament and a 1.5" to 2" staple length is an ideal substitute for cotton. In addition to its "feel" olefin fiber has the following characteristics:

1. Olefin fiber is easily converted into yarn using existing spinning systems
2. Olefin yarn will process well on knitting, weaving machines.
3. Olefin yarn is soft to the touch
4. Olefin staple processes well on non woven machines
5. Olefin fabrics feel similar to cotton
6. Olefin will dry quickly
7. Olefin will pass moisture but retain body heat.
8. Olefin is very stain resistant.

Disadvantage of Olefin Fiber and Yarn:

The main disadvantage of olefin is the fact that it is a fiber that is not dyeable by conventional dye systems. Almost all olefin fiber and yarn is pigment or solution dyed. Fabric made from pigment dyed yarn cannot be dyed to fashion shades as orders are received. This makes fabric manufacture prohibitively expensive and inventories too large to manage in the apparel and home furnishings industry. Polypropylene is presently used mainly for making carpet and rugs.

SUMMARY OF THE INVENTION

The object of the present invention is to create a novel knitted woven or non-woven fabric using synthetic yarn that has most of the characteristics of cotton fabrics and overcomes the disadvantages of polyester fabrics. To qualify as a good substitute for cotton fabrics, the fabric has to be available in greige goods, be easy to dye on conventional systems, be soft to touch; the fabric must "breathe" and wick moisture away from the body. The fabrics made using the synthetic yarns of the invention will be easy to wash either by hand or machine and will not stain by ordinary household food stains. The fabrics made using the invention are lighter in weight using standard size yarns and dry faster than cotton fabrics at room temperature. The fabrics made using this invention have superior light and wash fastness.

Further objects and further scope of the present invention will become: apparent from the detailed description given hereinafter. It should be understood however that the detailed descriptions and examples are given by way of illustration only since various changes and innovations within the spirit of this invention will become apparent to those skilled in the art.

Although the cotton spinning system is the most widely used system, one skilled in the art can produce fiber that can be made into yarn using any conventional spinning system. Worsted, woolen and modified worsted are some of the more common spinning methods. The fiber length and denier can be varied to fit any spinning system.

In addition to staple fiber spun into yarn there is a large production of continuous filament yarn. This invention can be applied to either fiber or continuous filament yarn.

Briefly described, the present invention relates to a method of using disperse dyeable synthetic olefin yarn and fibers to manufacture knitted woven and non woven fabric greige goods that are easy to dye and process using commercially available disperse dye systems. The novel advantages of these greige goods over cotton, and blends of cotton polyester will be apparent from the detailed description. This invention also shows the preferred novel additives to be grafted onto Olefin to make it disperse dyeable.

DETAILED DESCRIPTION OF THE INVENTION

The present invention relates to manufacturing a knitted, woven or non-woven fabric using an olefin yarn or fiber that has been enhanced to accept disperse dye. The olefin does not dye but the additive that is grafted to the olefin of the present invention will accept any disperse dye that is used at dye facilities used to dye polyester or blends of polyester and cotton. No special dyes have to be purchased to achieve shades of all description. The olefin of the invention will only accepts disperse dyes. This invention uses grafted additives in olefin to create yarns that are made into woven, knitted or non-woven greige goods fabric. The fabric of this invention is stored as uncolored inventory. The greige goods are colored using disperse dyes usually used to dye polyester. Very high temperatures used to dye polyester are not necessary to dye the olefin fabrics. A temperature of 220° F.–250° F. is ideal. Bright deep shades of any color are achieved when dyeing olefin fabrics using this invention.

Multitones:

Multitones are dyed in addition to just one solid color. Olefin yarns with dye enhancer grafted of from 1% to 15% is be used to make fabrics dye to multi-tones of the same shade in one dye bath containing disperse dyes. This is achieved by grafting varying strengths of the concentrate dye enhancer specified in this invention into the olefin fibers or yarns. By example, I will call a yarn with 5% dye enhancer A, a yarn with 3% dye enhancer B and a yarn with 1.5% dye enhancer C. When yarn A, B, and C are placed together on fabric forming machines, such as a weaving machine, the resultant fabric is dyed into novel three self tones of a: color in a single dye bath. One will be dark, one medium and one light. The preferred range of concentrate grafted is from 1% to 7%.

When a fabric is made using yarns containing two dye levels and one yarn without any concentrate the result will be a fabric with two tones and a white. This aspect creates novel and surprising effects. One skilled in the art will find many pleasing ways to make novel fabrics using this invention.

Solid Shades:

Fabric made from olefin yarn will dye a solid shade when made using yarn that has only one level of concentrate grafted. The preferred concentrate grafted should be 5% on the weight of the goods. Other concentrations can be used to vary the dye take up but I have found the preferred mixture to be 5% on the weight of the goods to make solid shades.

Surprising and novel effects can be achieved using 100% olefin yarns of this invention. Benefits of using Olefin made according to this invention follow:

1. Olefin fabric is wash fast in warm water.
2. Olefin fabric can be line dried or quickly machine dried at a cool temperature.
3. Disperse dyed olefin fabric does not stretch or shrink in the wash process.
4. Olefin fabric dries substantially wrinkle free.
5. Olefin fabric is stain resistant.
6. Olefin fabric is soft to the touch.
7. Olefin fabric is 380% lighter than cotton.
8. Olefin fabric will wick moisture and breathe.
9. Olefin fabrics will resist mildew and algae growths.
10. Olefin has a higher bulk than most fibers.
11. Olefin yarn can be manufactured by either spinning or continuous filament.
12. An olefin fabric is characterized by being an easy care, travel friendly garment.

Olefin Dye Enhancers:

There are various methods of making or enhancing olefin to accept dyes.

| Related Patents: | |
|---|---|
| 6,420,482 Domingguez et al | 4,320,046 Havens |
| 6,146,574 Henkee et al | 3,926,553 Fuest |
| 6,126,701 Calogero | 3,652,198 Farber et al |
| 5,576,366 Sheth | 3,622,264 Brown et al |
| 5,550,192 Sheth et al | 3,315,014 Coover et al |
| 5,169,405 Hoyt et al | 3,256,362 Craubuer et al |

All of the above patents instruct one skilled in the art on how to make a graft that when grafted onto polyolefin will make the polyolefin dyeable. All refer to a chemistry that is quite different from the chemistry of this invention. Craubuer No. 3,256,362 refers to unsaturated polyester, which differs from the rest of the above inventions. The Craubuer Patent requires a difficult to mix and unrelated type of polyester. The unsaturated polyester in that patent is not amorphous and does not blend well at lower temperatures required to produce olefin.

Each method described in the above patents incur problems spinning or extruding small sizes that are necessary for apparel. Dyeing yarns or fabrics of these prior patents requires special equipment or dye selection. None to the inventor's knowledge has been applied on a large scale to making apparel or woven home furnishings textile articles. The carpet industry has used the yarns in a limited manner. It is desirable to have a dyeable olefin that can be used for apparel and home furnishings and not be limited to carpet manufacture. In addition, it is only practical to use dyeable olefin when non-modified available disperse dye stuffs will enable the dyer to match shades in the laboratory that are transferable to the production dye machine with little or no modification. This invention allows the dyer to match shades in the laboratory that are easily transferred to the production machine.

A preferred method of rendering polyolefin disperse dyeable is as follows:

A mixture of amorphous PETG (glycol modified polyethylene terephthalate) is the preferred ingredient used to graft onto polyolefin. Amorphous PETG is selected because it melts at a temperature similar to that of polypropylene. This enables one skilled in the art to make dyeable Polyolefin using a conventional olefin fiber extrusion machine. No special equipment is needed to perform this operation. The advantage of this additive is the fact that drying and moisture reduction is not necessary to add the graft. In addition to the amorphous PETG this invention used maleic anhydride to improve the dispersion and graft cohesion in the olefin fiber. A preferred product is amorphous PETG No. 1428 from Eastman Chemical and Maleic Anhydride No. 3200 from Uniroyal. A blend using 96% PETG 1428 and 4% Maleic Anhydride is ideal (percentages are by weight unless otherwise specified). I let the blend down in polypropylene to create a: compound that is 50% active. 50% is polypropylene, 48% is amorphous PETG, and 2% is maleic anhydride. One skilled in the art will choose the appropriate method to make the compound. Of course this is the best suggestion but by experimentation, one skilled in the art would vary the percentages to suit their needs. The compound is in pellet form and packaged in Gaylord's or drums without special gas sealant necessary.

Maleic anhydride is used to help the graft securely anchor onto the polyolefin. The maleic anhydride is not necessary to make the olefin disperse dyeable. However I found that if the maleic anhydride is eliminated, the amorphous PETG does not disperse evenly. This results in uneven dispersion and unlevel dyeing.

Dyeable Olefin Fiber and Yarn:

Pellets containing 48% amorphous PETG (polyester) 2% Maleic Anhydride and 50% polypropylene are fed to an olefin fiber extruder using 10% owg (on weight of the goods). The result is a fiber containing 5% disperse dyeable mix grafted onto 95% olefin. One skilled in the art will vary the blend of graft to olefin to achieve the desired shade when subjected to a dye bath containing disperse dye. I have varied the mix and dyed the fiber and found the preferred enhancement to be 5% owg for deep solid shades and 2.5% owg for lighter shades. When subjecting a 5% owg fiber and a 2.5% owg fiber to a single dye bath a pleasing two-tone shade resulted from a single dye bath. I use the nomenclature "dye enhanced olefin" to describe the grafted product.

Pellets containing a blend of 50% olefin, 48% amorphous PETG and 2% Maleic Anhydride is preferred for the following reasons:

1. Disperse dye is the only dye that the graft will absorb.
2. The blend melts at the processing temperature of olefin
3. The blend combines and easily extrudes into pellets.
4. The blended pellets do not have to be bone dry to feed into the olefin fiber extruder
5. The blend mixes evenly and is well dispersed within the olefin during fiber extrusion.
6. The dyeable graft is stable when subjected to any dyeing conditions
7. Grafted yarn or fabric will dye or print using standard disperse dyes.
8. Printing is easily achieved and requires only 2 to 4 minutes exposure to steam at a 212° F. temp.
9. Colors are wash fast at warm temperatures of 175° F.
10. The graft enhances olefin "feel".

The present invention will now be described in more detail.

EXAMPLE I

Single Color Fabrics a.) Pellets of olefin with a Melt Flow Index of 8–22 are extruded and intimately mixed with the blend using the above-preferred mixture of PETG and Maleic Anhydride. The blend of 95% olefin and 5% PETG/Maleic is extruded into a staple mass using conventional staple extrusion equipment. The fiber dpf is 1.8 and is cut to 1.5". Approximately 1,000 pounds of staple are produced and baled. The denier per filament is close to that of cotton and so is the staple length.

b.) The dye enhanced olefin bales of staple fiber are blended together at the cotton carding process and made into an intimate blend of roving. The roving made using conventional cotton equipment is ring spun into a 10/1 cotton count and taken up on 3-pound packages. Approximate 1000 pounds of yarn is produced.

c.) The 10/1-olefin yarn is knitted on a 10 cut circular knitting machine. This manufacturing process forms an undyed greige goods fabric that is ideal to make cut and sewn sweaters.

d.) The sweater greige goods fabric is dyed in a conventional jet-dyeing machine ordinarily used to dye polyester. The temperature is kept at 250° F. to avoid damage to the olefin. A disperse dye Terasil Blue BRL at 0.005% owg is used with standard dye dispersion chemicals and water. The resultant sweater fabric is a novel and pleasing bright shade of deep blue. The fabric is dried in a relatively cool oven. The temperature is kept below the melt temperature of olefin or at 200° F. The water flashes off the olefin leaving a dry bright fabric, which is rolled and wrapped for shipment. Drying time is greatly reduced in comparison to a cotton or cotton polyester blend because the olefin only holds limited amounts of water.

f.) The sweater fabric is cut and sewn and is surprisingly novel. It is at least 30% lighter in weight than a cotton sweater made to the same specifications. This is because the olefin specific gravity is 0.91 Vs 1.38 for cotton or cotton polyester.

This novel sweater will actually float in water. The sweater has the look and feel of cotton yet is substantially lighter in weight. It is understood by one skilled in the art that different weight fabrics using various sizes of yarn can be produced in the same manner.

EXAMPLE II

Tone on Tone Olefin Fabric a.) Pellets of olefin with a Melt Flow Index of 8–22 are intimately mixed and grafted with an olefin dye enhancement blend described above. The mixture is 95% olefin with 5% disperse dye enhancement concentrate consisting of PETG and Maleic Anhydride as described in this invention. The mixture is extruded into a staple mass using conventional staple extrusion equipment. The dpf is 1.8 and the staple is cut to 1.5". Approximately 1,000 pounds of staple are produced and baled. The denier per filament is close to that of cotton and so is the staple length. This batch is called "staple A".

b) Pellets of olefin with a Melt Flow Index of 8–22 are intimately mixed and grafted with an olefin dye enhancement blend described above. The mixture is 97% olefin with 3% disperse dye enhancement concentrate consisting of PETG and Maleic Anhydride as described in this invention. The mixture is extruded into a staple mass using conventional staple extrusion equipment. The dpf is 1.8 and the staple is cut to 1.5". Approximately 1,000 pounds of staple are produced and baled. The denier per filament is close to that of cotton and so is the staple length. This batch is called "staple B".

c.) Separately the olefin bales of staple fiber are blended at the cotton carding process and made into roving. The roving is made using conventional cotton equipment is spun into a 10/1 cotton count and taken up on 3 pound packages. Approximate 1000 pounds of each yarn is produced for a total of 1,000 pounds of olefin with 5% concentrate (yam A) and 1000 pounds of olefin grafted with 3% concentrate (yarn B). Both will accept disperse dyes.

d.) Olefin Yarn A containing a 5% concentrate, and Olefin yarn B containing a 3% concentrate are placed side by side on a 10 cut knitting machine. Both yarns are 10/1. The olefin yarns are knitted on a 10 cut circular knitting machine. This manufacturing process forms an undyed greige goods fabric that is ideal to make sweaters when cut and sewn.

e.) The sweater greige fabric is dyed in a conventional jet-dyeing machine ordinarily used to dye polyester. The temperature is kept at 250° F. to avoid damage to the olefin. A disperse dye, Terasil Blue BRL at 0.005% owg is used with standard dye dispersion chemicals and water. The resultant sweater fabric is a novel and pleasing two-tone shade of blue. Only one dye bath is used to obtain more than one shade on the fabric. The fabric is dried in relatively cool oven. The temperature is kept below the melt temperature of olefin or 200° F. Drying time is greatly reduced in comparison to a cotton or cotton polyester blend. The water flashes off the olefin leaving a dry bright two-tone blue fabric, which is rolled and wrapped for shipment.

f.) The two-tone sweater fabric is cut and sewn and is surprisingly novel. The two-tone effect is novel and looks natural like a wool or linen. It is 30% lighter in weight than a cotton sweater made to the same specifications. This is because the olefin specific gravity is 0.91 Vs 1.38 for cotton or cotton polyester. This novel sweater will actually float in water.

It is to be understood that by varying the amount of concentrate and the number of olefin yarns fed to a knitting or weaving machine a person skilled in the art can create numerous fashionable and novel greige goods fabrics made from olefin, or blends of olefin with other yarns fed to various knitting or weaving machines. It is understood by one skilled in the art that different weight fabrics using various sizes of yarn can be produced in the same manner.

EXAMPLE III

Solid Shade of Continuous Filament Fabric a.) Pellets of olefin with a Melt Flow Index of 8-22 are extruded and intimately mixed with the blend using the above-preferred mixture of PETG and Maleic Anhydride The blend of 95% olefin and 5% PETG/Maleic is extruded into a continuous filament yarn using conventional extrusion equipment. The filament fiber dpf is 5.4. Approximately 1,000 pounds of yarn are produced and wound on perns.

b.) The undrawn yarn is drawn 3.0 to 1 and false twist textured on a conventional texturing machine. The textured yarn has 277 filaments of 1.8 denier each. The yarn is soft and feels like cotton. The yarn is bright and uncolored and put up on 3 pound cones. Proper spin finish is applied in the process.

c.) The textured yarn is knitted on a ten cut knitting machine. The result is a bright soft looking sweater greige fabric that is not dyed.

d.) The bright textured continuous filament sweater greige goods fabric is dyed in a conventional jet-dyeing machine ordinarily used to dye polyester. The temperature is kept bellow 250° F. to avoid damage to the olefin. A disperse dye Terasil Blue BRL at 0.005% owg is used with standard dye dispersion chemicals. The resultant sweater fabric is a novel and pleasing bright shade of solid colored deep blue. The fabric is dried in relatively cool oven. The temperature is kept below the melt temperature of olefin or 200° F. Drying time is greatly reduced in comparison to a cotton or cotton polyester blend. The water flashes off the olefin leaving a dry bright slinky fabric, soft to the touch, which is rolled and wrapped for shipment.

e.) The continuous filament sweater fabric is cut and sewn and is surprisingly novel. It is bright, "slinky" and fashionable. It is a solid color but by using the same technique as in example II above, one skilled in the art can vary the olefin yarns and achieve a two or three tone novel effect from one dye bath. It is 30% lighter in weight than a sweater made from polyester. This is because the olefin specific gravity is 0.91 Vs 1.38 for polyester. This novel sweater will actually float in water. It is wash and wear and would be ideal for a travel garment.

It should be understood by one skilled in the art that the same technique can be use to produce finer filaments of 20, 70, 120, 150 denier. The example above is to show that continuous filament yarns can be made dyeable using the same PETG and Maleic Anhydride blend that is used to make staple fiber dyeable. Woven fabric can also be made using these yarns.

EXAMPLE IV

Printing Olefin Fabrics

Screen Printing—The knitted fabric from Example I was fed to a 6 color aqueous continuous screen-printing machine. A standard dye paste using disperse dyes was prepared for each screen with thickener. The screens were made to allow a six color pleasing floral pattern to be produced. The print paste was screened on the fabric. The fabric was fed to a steam box to set the dyes. Two to four minutes of steam at 212° F. is required to set the dye. The fabric is fed to the steam box and is taken up in a continuous system washed of excessive dyes and dried. The result was a pleasing 6-color floral printed sweater fabric.

The novel effect was achieved without bleeding or excessive pick up. Drying time was greatly reduced and the oven was set to allow 200° F. to come in contact with the fabric. It is understood that woven fabric can also be processed using the same technique.

EXAMPLE V

Space Dye Printing Color on Yarn Using the Knit de Knit process a.) Pellets of olefin with a Melt Flow Index of 8–22 are extruded and intimately mixed with the blend using the above-preferred mixture of PETG and Maleic Anhydride The blend of 95% olefin and 5% PETG/Maleic is extruded into a staple mass using conventional staple extrusion equipment. The fiber dpf is 1.8 and is cut to 1.5". Approximately 1,000 pounds of staple are produced and baled. The denier per filament is close to that of cotton and so is the staple length.

b.) The olefin bales of staple fiber are blended together at the cotton carding process and made into roving. The roving is made using conventional cotton equipment is spun into a 10/1 cotton count and taken up on 3 pound packages. Approximately 1000 pounds of yarn is produced The 10/1 grafted olefin is plied to make a 10/2 dyeable olefin.

c.) Knitted Sleeve—The 10/2 olefin yarn is knitted into a single endless sleeve.

d.) Space dye printing—Three colors are printed on the sleeve using the knit de knit process well known in the art. This is a continuous process whereby the undyed sleeve passes through a squeegee roller submerged in a disperse dye: tank to apply the first shade of color. The sleeve continues to a second patterned roller, which over prints a second shade and then continues to a third roller, which over prints a patterned third shade. Each shade contains disperse dye. The colored knitted sleeve is exposed to steam for at least 2 minutes and preferably 4 minutes. This sets the disperse dye to an acceptable depth of shade. The knitted sleeve has a solid background shade of beige overprinted with deep brown and charcoal. The sleeve is then washed and dried on the continuous range. The dryer is set at a low temperature of 200° F. and the water is flashed off. The dried sleeve is collected in a can container and moved to the winding room.

e.) The resultant sleeve is de knitted or wound onto a yarn package using a winding operation well know to those skilled in the art. The yarn is a pleasing beige color with dots of dark brown and dark charcoal and is put up on 3-pound cones.

f.) The 10/2 olefin space dyed yarn is knitted on a 10 cut knitting machine. A pleasing three-tone space dyed fabric is the result. The space dyed fabric of olefin is surprisingly free of patterns usually associated with skein or dip dyeing of sweater yarns. The fabric is washed with hot water in a jet dye or winch dye machine to add bulk and to clarify the colors. This also assures the fact that the finished sweater will not shrink when washed by the end user. The fabric is dried in a cool oven at 200° F. While it is not necessary to wash the fabric, it is worth the extra step to make the fabric shrink proof.

g.) The space dyed sweater fabric is cut and sewn and is surprisingly novel. It is 30% lighter in weight than a cotton sweater made to the same specifications. This is because the olefin specific gravity is 0.91 vs 1.38 for cotton or cotton polyester. This novel sweater will actually float in water.

While this example uses a 10/2 yarn, it should be noted that any size dyeable olefin that would be practical to go through the knit de knit-system would be suitable. Many pleasing color effects can be achieved and should not be limited to the example set forth. One skilled in the art should experiment to find a pleasing result with either spun yarn or filament yarn.

Other methods of space dye or print dyeing yarn can be used. One skilled in the art will adjust the various machines to the specifications that I outlined above. Warp printing or package impregnation are two other common methods use to space dye yarns.

There are numerous sizes of yarns used to make fabrics. Spun yarns are usually made into 18's, 20's, 24's, 28's, 30's, 36's, 40's, either plied or in single form. Continuous filament yarn is usually made into 20/1, 70/1, 00/1, 150/1, 200/1 300/1, 500/1 or 1000/1. These are common sizes of yarns that are used to make woven, or knit fabrics. It should be understood that any size yarn or staple fiber could be made dyeable using the preferred mixture of the invention. From these yarns dyeable woven, non-woven or knitted fabrics of all types and descriptions will be made.

It should also be noted that there are continuous filament machines that extrude more than one color using multiple extruders to feed the spinneret. When a dye enhancer mix is introduced instead of pigment at differing percentage mixes into each extruder the result will be a continuous filament yarn that will accept various tones of a shade from a single dyebath.

EXAMPLE VI

Tri-Tone Filament Fabric a.) Pellets of olefin with a Melt Flow Index of 8-22 are intimately mixed and grafted with an olefin dye enhancement blend described above. This machine has three extruders that will separately feed a single spinneret. Barmag, Plantex, Rieter make such machines. One extruder is fed a mix of 95% olefin and 5% Dye enhancer, another is fed 97% olefin and 3% dye enhancer, and the third is fed 99% olefin and 1% dye enhancer. A single white yarn with a dpf of 5.4 consisting of three separate levels of dye affinity is taken up on three-pound packages.

b.) The yarn at this stage has to be drawn and textured. The yarn is drawn 3:0 and false twist textured on conventional draw twisting machinery known to those skilled in the art. The result is a continuous filament yarn having 300 ends of 1.8 dpf. One third of the yarn has a 5% additive, one third has 3% additive and one third has a 1% additive.

c.) The yarn is knitted on a 30" rib knitting machine. The tubular cloth produced is a white greige tube, which is shipped to the dye house.

d.) The tube is dyed with a 0.005% owg disperse dye. The surprising result is a dyed fabric that simulates a tweed fabric having a deep, medium and a light blue tone. ⅓ of the yarn accepted one level of disperse dye, ⅓ of the yarn accepted a second level of disperse dye, and ⅓ of the yarn accepted a third level of disperse dye.

e.) The fabric is opened, dried at a low temperature of 200° F. and rolled for shipment.

f.) The fabric is cut and sewn into a full-fashioned ribbed spring coat with dress buttons. One skilled in the art would vary both the size of the extrusion and the grafted disperse dyeable compound to achieve the effect that they desire.

Variations would be for one skilled in the art to knit a dyeable tri-tone yarn with a dyeable single tone yarn. When the fabric is dyed the fabric would have stripes of solid tones with stripes of tri-tones. This is just an example and should serve to show that many variations are now made possible using this invention. It would be desirable to feed two extruders with additive while the third produces an undyeable portion. When subjected to a disperse dye bath of terisil blue, two ends will dye blue while the third end will remain white.

A fabric containing tri-tone yarns would be ideal to space dye or print, as the printed yarn would dye into separate tones within tones at each strike of color letdown. Of course one skilled in the art should not be limited but should be guided by the above examples.

This invention enables the yarn spinner, the fabric maker and the dyer to create novel lightweight colored fabrics. It enables a fabric to be held until the last moment before dyeing and shipping to be manufactured in shades that match the current time of year and season.

EXAMPLE VII

Woven Fabric of Olefin

Olefin yarn is made according to the invention. It is enhanced to accept a deep solid shade of disperse dye. The size is 24/1 spun on the cotton spinning system taken up on three-pound cones. It contains a dyeable graft of 5% owg.

The appropriate multiple ends are slashed and taken up on a weaving beam. The beam is set to feed a simple box loom.

Olefin yarn made according to the invention containing 2.5% dyeable graft is made to feed the weft insertion on the box loom. The size is 24/1 spun on the cotton spinning system. A simple over and under woven fabric 60" wide is produced. By composition, one half of the yarn contains a 5% dye enhancer made according to the invention and one half contains a yarn that has a 2.5% dye enhancer made according to the invention.

The woven greige cloth is dyed in a jet dyer set at 250° F. with a Terasil Blue disperse dye using 0.005% on the weight of the goods.

The warp or beamed yarn dyes a deep shade of blue and the weft yarn dyes to a medium shade of blue. The fabric is a two-tone tweed color.

The fabric is dried in a relatively cool oven at 200° F. to keep the temperature below the melt temperature of olefin.

The fabric is tentered or held in a stretched position while it passes through drying oven. This "sets" the fabric so that it will not shrink in any further processing at a later time.

The fabric is cut and sewn into a ladies jacket and skirt. When combined the garment is a ladies suit made from 100% olefin fabric. This suit is easy care washable, stain resistant, and lightweight. It is 38% lighter than a similar suit made from polyester or wool/blends.

The above is an example. Using this invention, one skilled in the art could make many types of woven dyeable fabrics for use in the apparel or home furnishings industry. Patterns such as bird's eye, jacquard, twill or prints are some of the possibilities. Each will be lightweight, stain resistant, and able to be disperse dyed to any shade that the market will demand.

EXAMPLE VIII

Sheath-Core Filaments or Yarn

In U.S. Pat. No. 6,136,436 Kennedy et.al there is disclosed a method of manufacturing a sheath core continuous filament fiber or yarn. I will incorporate this process into this invention with the following addition:

The invention U.S. Pat. No. 6,136,436 claims a sheath of nylon or polyester on a core of olefin. In this example I use a core and sheath of olefin. The outer sheath comprises 10% to 70% olefin grafted with the dye enhance of amorphous PETG. The core is 100% olefin.

A fabric is knitted or woven with one or more yarns containing differing dye levels. The fabric is dyed as per the examples above. Great cost savings result because the sheath comprises only 10% to 70% of the total composition. One skilled in the art would vary the percentages of the sheath and the dye enhancer to achieve the effect desired.

A variation of the above is to use a sheath of non-dyeable olefin and a core of dyeable olefin. The result is a yarn with a clear outer shell with color in the core. One skilled in the art can manipulate this yarn or fiber to create the effect desired.

EXAMPLE IX

Fabric knitted or Woven Using Dyeable Olefin Blended with Polyester

A novel and surprising effect is achieved when blending polyester and dyeable olefin fiber to make yarn. The resultant yarn has an outer cover consisting mostly of polyester and a core mostly of dyeable olefin. There is minor crossover in both the sheath and core.

Olefin fiber is made according to the invention. The fiber is enhanced with the additive of this invention to accept a solid shade of disperse dye a.) Pellets of olefin with a Melt Flow Index of 8–22 are extruded and intimately mixed with the blend using the invention's preferred mixture of PETG and Maleic Anhydride. The blend of 95% olefin and 5% PETG/Maleic is extruded into a staple mass using conventional staple extrusion equipment. The fiber dpf is 1.8 and is cut to 1.5". Approximately 650 pounds of staple are produced and baled. The denier per filament is close to that of cotton and so is the staple length.

b.) Dye enhanced olefin staple fibers are blended together with polyester staple fibers having a 1.35 denier per filament cut to a 1.5" staple length at the cotton carding process and made into an intimate blend of roving containing 65% dyeable olefin and 35% polyester. The roving is made using conventional cotton equipment and is ring spun into a 28/1 cotton count then taken up on 3-pound packages.

c.) Approximate 1000 pounds of a unique yarn is produced. The heavier polyester having a specific gravity of 1.38 migrates to the outside of the yarn due to centrifugal force and becomes a sheath surrounding the lighter weight olefin which remains mostly in the core.

d.) The yarn is twist plied into a 28/2 ply yarn. Both ends contain 65% dyeable olefin and 35% polyester.

e.) This yarn is then converted to a woven greige cloth on a conventional box loom using 40 ends per inch in the warp and 40 ends per inch in the fill. The fabric is woven to 67" width.

f.) The greige goods fabric is dyed in a conventional jet-dyeing machine ordinarily used to dye polyester. The temperature is kept at 250° F. to avoid damage to the olefin. A disperse dye Terasil Blue BRL at 0.005% owg is used with standard dye dispersion chemicals and water. The resultant woven fabric is a novel and pleasing bright shade of deep blue. The fabric is dried in a relatively cool oven. The temperature is kept below the melt temperature of olefin but is elevated to 255° F. as the core of olefin is shielded by the sheath of polyester. The water flashes off leaving a dry bright fabric, which is rolled and wrapped for shipment. Drying time is greatly reduced in comparison to a cotton or cotton polyester blend because the olefin only holds limited amounts of water and only 35% of the fabric is polyester.

g.) A novel result is a fabric that shrinks in with to 61.5" after finishing. The fabric is then stable and does not shrink more than 1% after washing. This effect makes the fabric a wash and wear easy care fabric.

h.) The woven dyed fabric is cut and sewn and is surprisingly novel. It is at least 20% lighter in weight than a polyester garment made to the same specifications. This is because the polyester/olefin specific gravity is 1.07 Vs 1.38 for polyester. The fabric has the soft feel of cotton yet is substantially lighter in weight. It is understood by one skilled in the art that different weight fabrics using various sizes of yarn can be produced in the same manner. In addition the yarn can be used to knit fabric using conventional knitting machines.

Woven, knitted or non-woven fabrics can be produced using this blend.

The advantages of a fabric and yarn made with a blend of polyester and dyeable olefin are as follows:

1.) The weaving, knitting, and dying process is fully developed in all parts of the world.
2.) Deeper dyeing polyester can be used as the sheath.
3.) Fabrics can be piece dyed or printed using conventional equipment.
4.) Sublimation Printing using heat transfer process can be used.
5.) Fabric is lighter in weight that 100% polyester or 100% cotton or a blend of both.
6.) Permanent press is easily implemented.
7.) Fabric is washable and line or machine dry-able.
8.) Use of micro denier polyester creates a soft fabric.
9.) The fabric will sew on any conventional sewing machine.
10.) The dyed fabric will not shrink more than 1–5%.

EXAMPLE X

Fabric Woven or Knitted Using Dyeable Olefin Blended with Nylon

A novel and surprising effect is achieved when blending Nylon and dyeable olefin fiber to make yarn. The resultant yarn has an outer cover consisting mostly of nylon and a core mostly of dyeable olefin. There is minor crossover in both the sheath and core. The resultant yarn has a sheath mostly of Nylon and a core mostly of dyeable olefin.

Olefin fiber is made according to the invention. The fiber is enhanced to accept a solid shade of disperse dye.

a.) Pellets of olefin with a Melt Flow Index of 8–22 are extruded and intimately mixed with the blend using the above-preferred mixture of PETG and Maleic Anhydride. The blend of 95% olefin and 5% PETG/Maleic is extruded into a staple mass using conventional staple extrusion equipment. The fiber dpf is 1.8 and is cut to 1.5". Approximately 650 pounds of staple are produced and baled. The denier per filament is close to that of cotton and so is the staple length.

b.) Dye enhanced olefin staple fibers are blended together with Nylon staple fibers having a 1.35 denier per filament cut to a 1.5" staple length at the cotton carding process and made into an intimate blend of roving containing 65% dyeable olefin and 35% Nylon. The roving made using conventional cotton equipment is ring spun into a 28/1 cotton count and the yarn is taken up on 3-pound packages.

c.) Approximate 1000 pounds of a unique yarn is produced. The heavier Nylon having a specific gravity of 1.14 migrates to the outside of the yarn due to centrifugal force and becomes a sheath surrounding the lighter weight olefin which remains mostly in the core.

c.) The yarn is twist plied into a 28/2 ply yarn.

c.) This yarn is then converted to a woven greige cloth on a conventional box loom using 40 ends per inch in the warp and 40 ends per inch in the fill. The fabric is woven to 67" width.

d.) The greige goods fabric is dyed in a conventional jet-dyeing machine ordinarily used to dye fabric. The temperature is kept at 250° F. to avoid damage to the olefin. A disperse dye Terasil Blue BRL at 0.005% owg is used with standard dye dispersion chemicals and water. The resultant woven fabric is a novel and pleasing bright shade of deep blue. The fabric is dried in a relatively cool oven. The temperature is kept below the melt temperature of olefin but is elevated to 255° F. as the core of olefin is shielded by the sheath of Nylon. The water flashes off leaving a dry bright fabric, which is rolled and wrapped for shipment. Drying time is greatly reduced in comparison to a cotton or cotton polyester blend because the olefin only holds limited amounts of water and only 35% of the fabric is nylon.

e.) When an acid dye is used to dye the fabric only the nylon will dye. If a disperse dye and an acid dye is used then the nylon can be dyed one shade while the olefin will dye to another creating a distinct heather effect. A novel result is a fabric that shrinks in with to 61.5" after finishing. The fabric is then stable and does not shrink more than 1–5% after washing. This effect makes the fabric a wash and wear easy care fabric.

f.) The woven dyed fabric is cut and sewn and is surprisingly novel. It is at least 20% lighter in weight than a cotton garment made to the same specifications. This is because the Nylon/olefin specific gravity is 0.99 Vs 1.38 for cotton The fabric has the soft feel of cotton yet is substantially lighter in weight. One skilled in the art understands that different weight fabrics using various sizes of yarn can be produced in the same manner.

Woven, knitted or non-woven fabrics can be produced using this blend. Nylon is very easy to dye using an aqueous dye system. The fabrics made of nylon and olefin blends will print using any acid system commonly used to dye nylon or silk.

In addition, the fabric can be printed using any aqueous dye system commonly used to print nylon, silk or polyester.

The advantages of a fabric and yarn made with a blend of Nylon and dyeable olefin are as follows:

1.) The weaving, knitting, and dying process is fully developed in all parts of the world.
2.) Fabrics can be piece dyed using conventional equipment.
3.) Fabrics can be piece dyed using nylon dye methods.
4.) Deeper dyeing nylon can be used as the sheath.
5.) Cationic dyeing nylon can be used as the sheath.
6.) Printing using any aqueous systems can be accomplished.
7.) Fabric is lighter in weight that 100% nylon, 100% cotton or blend of polyester/cotton.
8.) Fabric is washable and line or machine dryable.
9.) Use of micro denier nylon creates a soft fabric.
10.) The fabric will sew on any conventional sewing machine.

What is claimed is:

1. A spun yarn comprising a fiber blend of polyester fibers and polyolefin fibers, wherein the polyolefin fibers are a mixture of olefin mixed with a modifier comprising amorphous PETG and maleic anhydride.

2. The yarn of claim 1, wherein (a) said modifier includes PETG and maleic anhydride in a ratio of about 48 parts PETG to about 2 parts of maleic anhydride.

3. The yarn of claim 2, wherein (a) said modifier includes polypropylene in a ratio of about 50 parts polypropylene to 48 parts PETG to about 2 parts maleic anhydride.

4. The yarn of claim 3, wherein (a) said modifier is mixed with olefin in a ratio of about 95 parts olefin to about 5 parts of said modifier.

* * * * *